United States Patent [19]

Heichberger

[11] Patent Number: 4,498,303

[45] Date of Patent: Feb. 12, 1985

[54] CARBON DIOXIDE LIQUIFICATION SYSTEM

[76] Inventor: Albert N. Heichberger, P.O. Box 16562, Jacksonville, Fla. 32245

[21] Appl. No.: 511,270

[22] Filed: Jul. 6, 1983

[51] Int. Cl.[3] ..... F25J 3/02

[52] U.S. Cl. ..... 62/21; 62/37

[58] Field of Search ..... 62/9, 11, 102, 21, 36, 62/37, 45, 54, 56

[56] References Cited

U.S. PATENT DOCUMENTS 2,608,838 9/1952 Rupp ..... 62/10

*Primary Examiner*—Frank Sever

*Attorney, Agent, or Firm*—Jones & Askew

[57] ABSTRACT

A carbon dioxide liquification system. Gaseous carbon dioxide containing at least one contaminating gas having a lower temperature of liquification than the gaseous carbon dioxide, such as oxygen or nitrogen, is bubbled through liquid carbon dioxide such that the gaseous substances undergo heat exchange with the liquid carbon dioxide. Sufficient heat exchange takes place so as to liquify the gaseous carbon dioxide but not sufficient to substantially liquify the contaminating gas. The contaminating gas is permitted to escape from the liquid carbon dioxide. Apparatus for practicing the present invention is also disclosed.

11 Claims, 2 Drawing Figures

CARBON DIOXIDE LIQUIFICATION SYSTEM

TECHNICAL FIELD

The present invention relates to a system for liquidifying gaseous carbon dioxide, and more particularly, to such a system wherein gaseous carbon dioxide containing at least one contaminating gas is selectively liquified so as to provide liquid carbon dioxide relatively free of contamination.

BACKGROUND OF THE INVENTION

Various methods of liquifying gaseous carbon dioxide are well known. Typically, the liquification process comprises compressing the gaseous carbon dioxide to a pressure above atmospheric pressure and then removing the latent heat of vaporization to condense the compressed gas. In this way, although the sublimation temperature of solid carbon dioxide is approximately −109.9° F. at STP, the compressed gaseous carbon dioxide can be condensed at much higher temperatures.

The theoretical range of pressures over which gaseous carbon dioxide can be condensed to a liquid is approximately 60.45 to 1057.4 psig. However, most commercial processes operate in the range of approximately 225 to 300 psig. In this range, the temperature at which gaseous carbon dioxide gas will condense is −14° F. at 225.25 psig and −8° F. at 251.96 psig. Therefore, it will be appreciated that liquification can be accomplished without the use of sophisticated refrigeration equipment to achieve very low temperatures. Rather, standard refrigeration systems using ammonia or fluorocarbon refrigerants, such as freon, can be used.

Liquified carbon dioxide has many applications, but is particularly useful in the beverage industry for carbonating beverages, such as beer and soft drinks. However, in order for the carbon dioxide to be of maximum usefulness, it must be as pure as possible, i.e. free of contaminating gas such as oxygen and to a lesser extent nitrogen. If the carbon dioxide contains a significant amount of oxygen, the beverage in which it is used will be subject to oxidation and spoilage.

In a typical liquification apparatus, gaseous carbon dioxide is passed through a tube which is surrounded by a refrigerant. The carbon dioxide condenses on the sides of the tube and collects in the bottom thereof. Since the tube is filled with gaseous carbon dioxide, there is a large surface area at the interface of the liquid carbon dioxide and the gaseous carbon dioxide. This condition permits contaminating gases in the gaseous carbon dioxide to combine with the liquid carbon dioxide, not by liquification, but by solution. As a result, the liquid carbon dioxide is contaminated with undesirable solubilized gaseous substances, such as oxygen and nitrogen.

Heretofore a system for economically providing substantially pure liquified carbon dioxide has not been known.

SUMMARY OF THE INVENTION

The present invention relates to a system for liquidifying gaseous carbon dioxide. A carbon dioxide liquification system. Gaseous carbon dioxide containing at least one contaminating gas having a lower temperature of liquification than the gaseous carbon dioxide, such as oxygen or nitrogen, is bubbled through liquid carbon dioxide such that the gaseous substances undergo heat exchange with the liquid carbon dioxide. Sufficient heat exchange takes place so as to liquify the gaseous carbon dioxide but not sufficient to substantially liquify the contaminating gas. The gaseous contaminating gas is then permitted to escape from the liquid carbon dioxide. Apparatus for practicing the present invention is also disclosed.

Accordingly, it is an object of the present invention to provide an improved system for liquifying gaseous carbon dioxide.

Another object of the present invention is to provide a system for liquifying gaseous carbon dioxide which provides a substantially pure liquid product.

A further object of the present invention is to provide a system for selectively liquifying gaseous carbon dioxide and separating it from contaminating gases, such as oxygen and nitrogen.

These and other objects, features and advantages of the present invention will become apparent after reviewing the following detailed description of the disclosed embodiment and the appended drawing and claims.

DETAILED DESCRIPTION OF THE DISCLOSED EMBODIMENT

Figure 1:
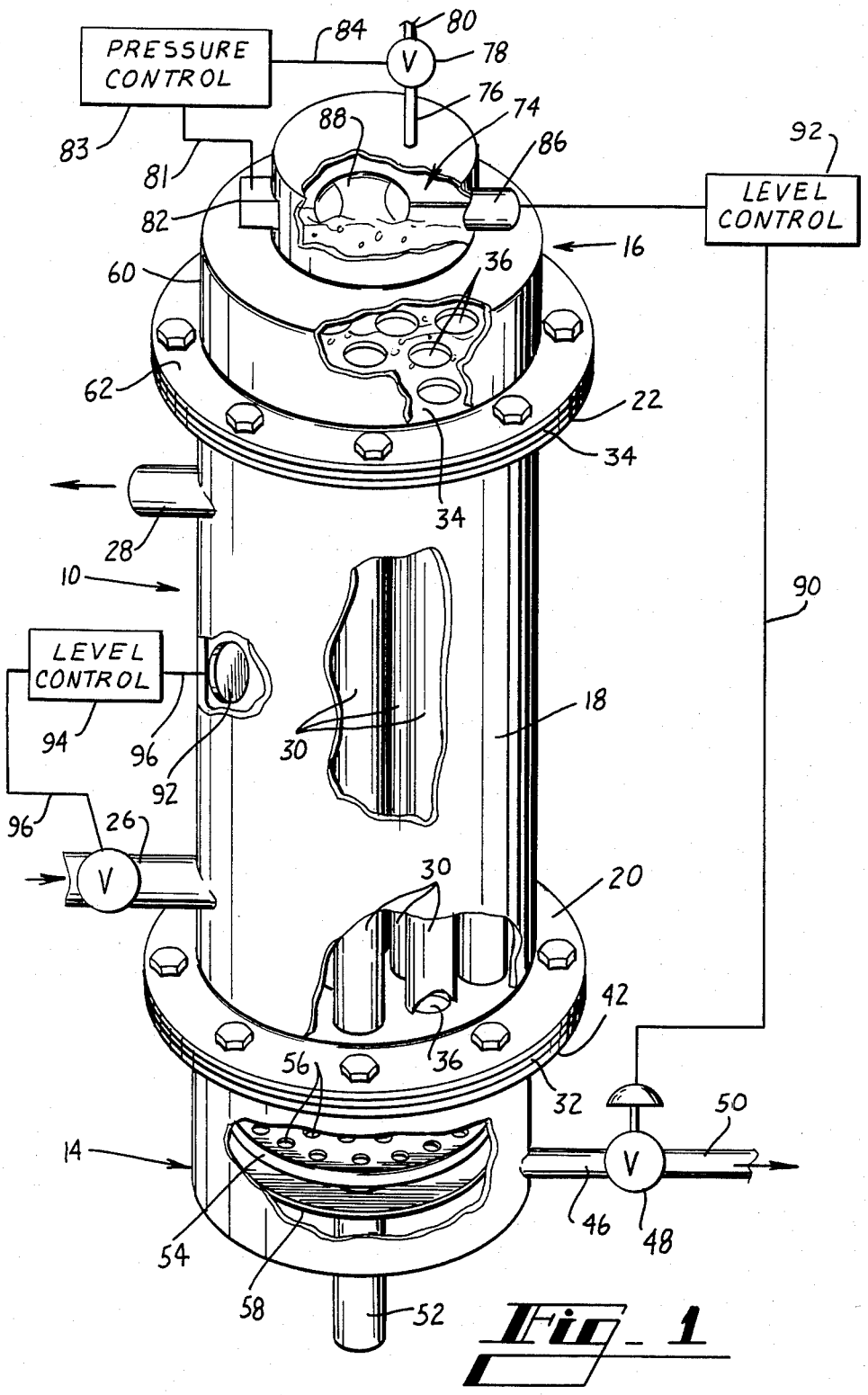
FIG. 1 is a perspective view of a disclosed embodiment of a carbon dioxide liquification apparatus of the present invention shown partially broken away and partially schematically.
Figure 2:
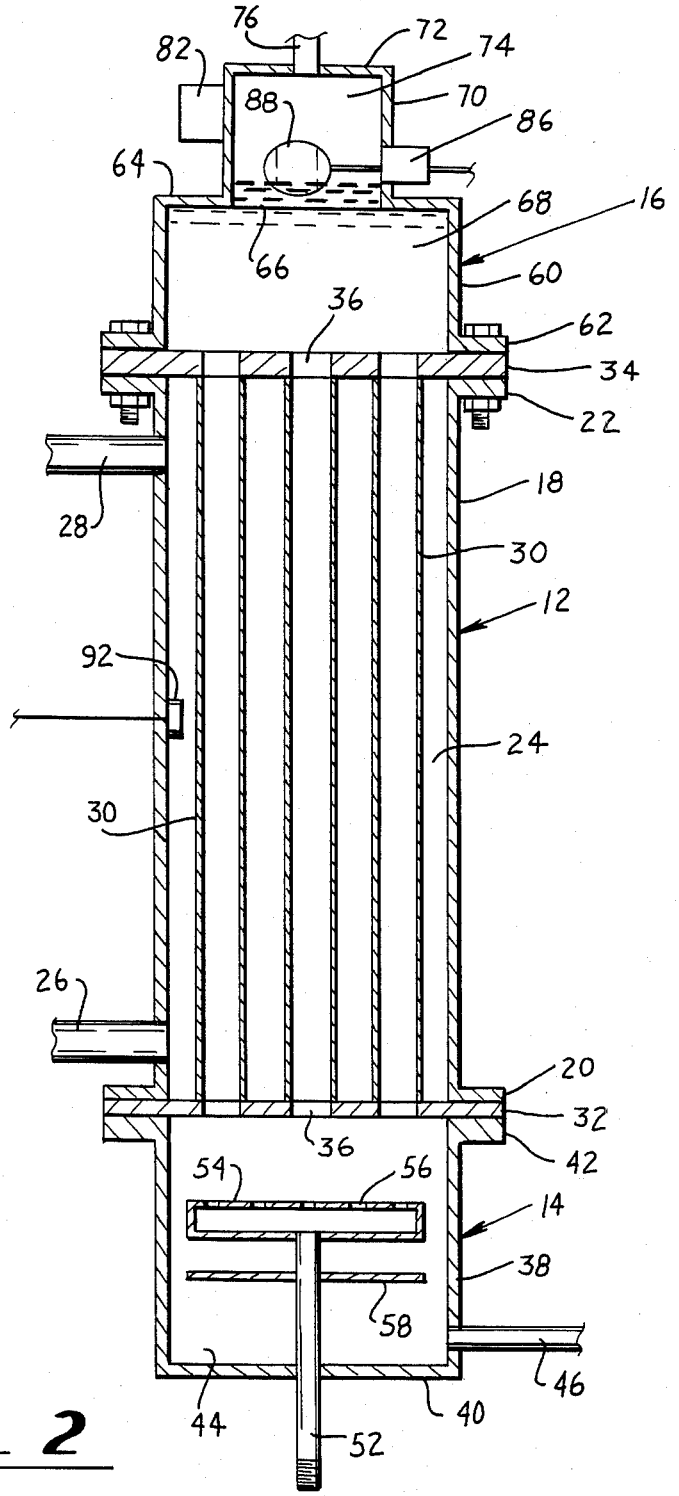
FIG. 2 is a cross-sectional view taken of the apparatus shown in FIG. 1.

Referring now to the drawing in which like numbers indicate like elements throughout the several views, it will be seen that there is provided a heat exchanger 10 in accordance with the present invention. The heat exchanger 10 includes three sections: a central cooling section 12, a lower inlet section 14 and an upper outlet section 16. Although the heat exchanger 10 is shown in a vertical orientation, it is specifically contemplated that a heat exchanger in accordance with the present invention can be provided for a horizontal installation.

The central cooling section 12 comprises a hollow annular sleeve or shell 18 having outwardly extending flanges 20, 22 at each end thereof. The shell 18 partially defines a refrigeration chamber 24 for containing a secondary refrigerant, such as ammonia, freon or other suitable refrigerant.

Extending through the shell 18 and scaled thereto are two pipes 26, 28 which are in fluid communication with the chamber 24. The other ends of the pipes 26, 28 are connected to a conventional closed cycle refrigeration system (not shown). The pipe 26 is an inlet to the refrigeration chamber 24 and conducts liquid refrigerant from the refrigeration system into the refrigeration chamber. Within the refrigeration chamber 24, the liquid refrigerant boils, thereby absorbing heat from its surroundings. The expanded refrigerant gas is then conducted back to the refrigeration system from the refrigeration chamber 24 by the pipe 28. At the refrigeration system, the refrigerant gas is recompressed and condensed in a conventional manner well known in the art.

Extending longitudinally through the refrigeration chamber 24 are a plurality of pipes or tubes 30. The tubes 30 are connected at their lower end to a plate or tube sheet 32 and at their upper end to a plate or tube sheet 34. Holes 36 are provided through the tube sheets 32, 34 at their juncture with the tubes 30 so that fluid communication through the tube sheets from within the tubes and the side of the tube sheets opposite the tubes is possible. The tube sheets 32, 34 are constructed so that they seal against the flanges 20, 22 respectively and provide an air tight seal therewith. Furthermore, the tube sheets 32, 34 define the upper and lower ends of the refrigeration chamber 24.

The lower inlet section 14 comprises a lower annular sleeve 38 sealed at its lower end by a plate 40 and having outwardly extending flanges 42 at its other end. The tube sheet 32 and the flanges 42 are constructed so that an air tight seal is provided therebetween. The lower sleeve 38, and the plates 32, 40 define a lower chamber 44. Connected to the lower sleeve 38 is one end of a pipe 46 which is in fluid communication with the lower chamber 44. The other end of the pipe 46 is connected to a conventional electrically or pneumatically operated modulating type control valve 48. Connected to the other side of the valve 48 is a pipe 48 which is connected at its other end to a conventional liquid carbon dioxide storage tank (not shown).

Extending through the plate 40 and sealed thereto is a pipe 52. One end of the pipe is connected to a sparger or gas distributor 54. The gas distributor 54 comprises a hollow plate having a plurality of holes 56 formed in the upper surface thereof so that gas within the distributor can escape therethrough. The other end of the pipe 52 is connected to a supply (not shown) of gaseous carbon dioxide under pressure. Disposed on the pipe 52 immediate the plate 40 and the distributor 54 is a baffle plate 58.

The upper outlet section 16 of the heat exchanger 10 comprises an upper annular sleeve 60 having outwardly extending flange 62 at its lower end. The tube sheet 34 and the flange 62 are constructed so that an air tight seal is provided therebetween. Attached to the upper end of the upper sleeve 60 is a plate 64 having formed centrally thereof a hole 66. The sleeve 60, the tube sheet 34 and plate 64 define an upper chamber 68.

Attached in sealing engagement with the upper surface of the plate 64 and coaxially aligned with the hole 66 is a sleeve 70. The sleeve 70 is sealed at its upper end by a plate 72. The sleeve 70 and the plate 72 define an upper gas separation chamber 74. Attached to the plate 72 and in fluid communication with the gas separation chamber 74 is a pipe 76. The other end of the pipe 76 is connected to a conventional electrically operated solenoid valve 78. The other side of the valve 78 is connected to a pipe 80.

Attached to the sleeve 70 and in fluid communication with the chamber 74 is a conventional gas pressure sensor 82. The pressure sensor 82 is connected to the a solenoid valve 78 through a pressure control switch 83 by an electric circuit 84. The solenoid valve 78 can therefore be operated in response to changes in the pressure of gas in the gas separation chamber 74.

Also attached to the sleeve 70 is a conventional liquid level sensor 86 including a float 88 extending into the chamber 74. The liquid level sensor 86 is connected to the valve 48 by an electric circuit 90 through a liquid level control circuit 92. The valve 48 can therefore be operated in response to changes in the level of liquid in the gas separation chamber 74.

Disposed within the refrigeration chamber 24 is a conventional refrigerant level sensor 92 which is connected to a solenoid valve 93 through a level control circuit 94 by an electric circuit 96. The solenoid valve can therefore be operated in response to changes of the refrigerant level in the refrigerant chamber 24 to maintain the desired level of refrigerant in the chamber and therefore a desired amount of heat exchange between the refrigerant and the liquid carbon dioxide in the tubes 30.

Operation of the heat exchanger 10 will now be considered. The lower chamber 44, the tubes 30 and the upper chamber 68 are filled with liquid carbon dioxide. The refrigeration system is turned on so that refrigerant is intermittently delivered to the refrigeration chamber 24 through the pipe 26. The liquid refrigerant in the chamber 24 boils or expands, thereby absorbing heat from the liquid carbon dioxide in the tubes 30. Gaseous refrigerant is returned to the refrigeration system through the pipe 28. The temperature of the refrigerant in the refrigeration chamber 24 is maintained by the refrigeration system so that the temperature of the liquid carbon dioxide in the tubes is below that which is necessary to condense gaseous carbon dioxide at a selected pressure.

Gaseous carbon dioxide containing at least one contaminating gas having a lower liquification temperature than the liquid carbon dioxide, such as oxygen and nitrogen, at a pressure of between approximately 70 and 1050 psig, having corresponding condensation temperatures of approximately −69.9° and 87.8° F., respectively, preferably between approximately 225 and 300 psig is delivered to the gas distributor 54 through the pipe 52. For illustration purposes, assume that the carbon dioxide gas is at a pressure of approximately 250 psig. Since the carbon dioxide gas at that pressure will condense at approximately −8° F., the refrigeration system is set so that the liquid carbon dioxide in the tubes 30 is below −8° F. The degree of the temperature below −8° F. will determine the gradient of the heat flow from gaseous carbon dioxide to the liquid carbon dioxide without boiling the intermediate carbon dioxide refrigerant. That temperature can be selected as described hereinbelow.

As the gaseous carbon dioxide emerges from the holes 56 in the gas distributor 54 it forms bubbles which float upwardly through the liquid carbon dioxide in the lower chamber 44, the tubes 30 and the upper chamber 68. As the bubbles of gaseous carbon dioxide pass through the cooler liquid carbon dioxide, the gaseous carbon dioxide undergoes heat exchange with the liquid carbon dioxide, i.e. heat is transferred from the gas to the liquid. When sufficient heat has been removed from the gas (the latent heat of vaporization) the gas will condense into the liquid carbon dioxide.

Since the carbon dioxide also contains contaminating gas with a lower temperature of liquification, and a different latent heat of vaporization, the contaminating gas requires a lower temperature and a different amount of heat transfer to condense than does the gaseous carbon dioxide. Therefore, the carbon dioxide will condense before contaminating gases, such as oxygen and nitrogen, will condense. The contaminating gas will therefore remain a gaseous state, whereas the carbon dioxide will liquify.

The temperature of the refrigerant should therefore be below the liquification temperature of carbon dioxide, but greater than the liquification temperature of the contaminating gas. Furthermore, the temperature should be sufficiently below the liquification temperature of the gaseous carbon dioxide so that sufficient heat transfer occurs between the gaseous carbon dioxide and the liquid carbon dioxide between the time the bubble leaves the gas distributor 54 and the time the gas bubble reaches the surface of the liquid carbon dioxide, preferably before the bubble passes the plate 34.

It will therefore be appreciated that as the gaeous bubble travels upwardly through the liquid carbon dioxide, the gaseous carbon dioxide within the bubble gradually condenses. It will also be understood that the contaminating gas which has a lower temperature of liquification does not substantially condense, but rather remains a gas. At a point along the travel of the gaseous bubble upwardly through the liquid carbon dioxide, all of the gaseous carbon dioxide will have condensed out of the bubble leaving only the gaseous contaminating gas.

The contaminating gas bubble is permitted to float to the top of the liquid carbon dioxide where it collects in the gas separation chamber 74. The diameter of the gas separation chamber 74 is smaller than the diameter of the upper chamber 68 so as to reduce the surface area of the liquid carbon dioxide exposed to the contaminating gas so as to reduce the possibility for the contaminating gas to enter into solution in the liquid carbon dioxide.

As the contaminaing gas collects in the gas separation chamber 74, the pressure of the gas contained therein will increase. The presure sensor 82 senses the pressure of the gas in the gas separation chamber 74 and the pressure control circuit 83 opens the valve 78 to permit gas to escape from the chamber at a predetermined pressure. The pressure of the gas in the gas separation chamber 74 can thereby be maintained at a predetermined level.

As the gaseous carbon dioxide condenses from the gaseous bubbles into the liquid carbon dioxide, the volume of the liquid carbon dioxide increases, and therefore the level of liquid carbon dioxide rises into the gas separation chamber 74. As it does so, the float 88 floats on the surface of the liquid carbon dioxide. When the level of the liquid carbon dioxide reaches a predetermined level, the float actuates the level sensor 86 and the level control circuit 92 opens the valve 48 to permit liquid carbon dioxide to escape from the lower chamber 44 through the pipes 46, 50. The baffle plate 58 is provided to reduce the turbulence in the liquid carbon dioxide adjacent the pipe 46 so as to reduce the possibility of withdrawing entrained gas in the liquid carbon dioxide as it is removed from the lower chamber 44.

As the level of the liquid carbon dioxide falls in the gas receiving chamber 74, the float 88 follows the liquid surface downwardly, actuating the level sensor 86 and causing the level control circuit 92 to throttle the valve 48 thus maintaining a predetermined level. It will therefore be appreciated that the level of the liquid carbon dioxide can be maintained at a desired predetermined level. It will also be understood that virtually pure liquid carbon dioxide is produced in a continuous process using the heat exchanger 10.

It should be understood, of course, that the foregoing relates only to preferred embodiments of the present invention and that numerous modifications or alterations may be made therein without departing from the spirit and scope of the invention as set forth in the appended claims.

I claim:

1. A process for selectively condensing carbon dioxide from a source gas flow, comprising:

providing an initial quantity of liquid carbon dioxide in a vertical configuration including, in ascending order, a lower removing region, a gas distributing region, a condensing region, and a gas collecting region;

said liquid carbon dioxide being at selected temperature and pressure conditions above condensation conditions for all components of said source gas except carbon dioxide;

introducing said flow of source gas into said gas distributing region and distributing said flow in said liquid carbon dioxide within said distributing region;

removing heat from said liquid carbon dioxide within said condensing region, as distributed gas rises in said liquid carbon dioxide from said distributing region through said condensing region, at a heat removal rate sufficient to maintain said selected temperature condition and to selectively condense substantially all carbon dioxide from said distributed gas;

collecting noncondensed gas in said gas collecting region as noncondensed gas rises from said liquid carbon dioxide above said condensing region; and removing substantially only carbon dioxide liquid from said lower removing region below said gas distributing region.

2. The method of claim 1, wherein said liquid carbon dioxide is at a temperature between approximately −69.9° and 87.8° F.

3. The method of claim 1, wherein said gaseous carbon dioxide is condensed at a temperature between approximately −8° and −14° F.

4. The method of claim 1, wherein said gaseous substances are at a pressure between approximately 225 and 300 psig.

5. The method of claim 1 wherein said introducing and distributing step comprises bubbling said source gas into said liquid carbon dioxide within said distributing region.

6. The process of claim 1 further comprising controlling release of noncondensed gas from said gas collection region in response to the pressure in said gas collection region, to control the pressure in said liquid carbon dioxide.

7. The process of claim 1 further comprising controlling said removing of carbon dioxide liquid from said lower removing region, in response to the level of liquid carbon dioxide above said condensing region.

8. Apparatus for selectively condensing carbon dioxide from a source gas flow, comprising:

a chamber configured to contain a quantity of liquid carbon dioxide in vertically arranged regions including, in ascending order, a lower removing region, a gas distributing region, a condensing region, and a gas collecting region;

inlet means for introducing said flow of source gas into said gas distributing region and distributing said flow in said liquid carbon dioxide within said distributing region;

cooling means for removing heat from said liquid carbon dioxide within said condensing region, as distributed gas rises in said liquid carbon dioxide from said distributing region through said condensing region;

said condensing region being sized and shaped and arranged such that as distributed gas passes through said liquid carbon dioxide in direct heat exchange relationship sufficient heat exchange occurs to selectively condense substantially all carbon dioxide from said distributed gas;

collecting means for collecting noncondensed gas in said gas collecting region as noncondensed gas rises from said liquid carbon dioxide above said condensing region; and outlet means for removing carbon dioxide liquid from said lower removing region below said gas distributing region.

9. The apparatus of claim 8 wherein said inlet means comprises a sparger.

10. The apparatus of claim 8 further comprising means for controlling release of noncondensed gas from said gas collection region in response to the pressure in said gas collection region, to control pressure in said liquid carbon dioxide.

11. The apparatus of claim 8 further comprising means for controlling said removing of carbon dioxide liquid from said lower removing region in response to the level of liquid carbon dioxide above said condensing region.

* * * * *